US006883188B2

(12) United States Patent
Sigler et al.

(10) Patent No.: US 6,883,188 B2
(45) Date of Patent: Apr. 26, 2005

(54) TOILET AND METHOD OF OPERATION

(75) Inventors: James A. Sigler, Perrysville, OH (US); Nathan A. Snyder, Big Prairie, OH (US); Robert D. Krieder, Sullivan, OH (US); Steven L. Miko, Wooster, OH (US); Randall Thomas, Millersburg, OH (US)

(73) Assignee: SeaLand Technology, Inc., Big Prairie, OH (US)

( * ) Notice: Subject to any disclaimer, the term of this patent is extended or adjusted under 35 U.S.C. 154(b) by 200 days.

(21) Appl. No.: 10/258,156

(22) PCT Filed: Nov. 27, 2001

(86) PCT No.: PCT/US01/44102

§ 371 (c)(1),
(2), (4) Date: Oct. 18, 2002

(87) PCT Pub. No.: WO02/44483

PCT Pub. Date: Jun. 6, 2002

(65) Prior Publication Data

US 2003/0121092 A1 Jul. 3, 2003

Related U.S. Application Data

(60) Provisional application No. 60/253,113, filed on Nov. 28, 2000.

(51) Int. Cl.[7] ..... E03D 11/10
(52) U.S. Cl. ..... 4/434
(58) Field of Search ..... 4/434, 435, 438, 4/441

(56) References Cited

U.S. PATENT DOCUMENTS

| | | | | | |
|---|---|---|---|---|---|
| 3,811,135 | A | | 5/1974 | Drouhard et al. | |
| 4,297,751 | A | * | 11/1981 | Olin et al. | 4/431 |
| 4,713,847 | A | * | 12/1987 | Oldfelt et al. | 4/316 |
| 4,918,764 | A | * | 4/1990 | Haselswerdt et al. | 4/406 |
| 5,201,082 | A | * | 4/1993 | Rockwell | 4/665 |
| 5,317,763 | A | * | 6/1994 | Frank et al. | 4/434 |
| 6,349,424 | B1 | | 2/2002 | Stradinger et al. | |
| 6,584,623 | B1 | * | 7/2003 | Grech et al. | 4/434 |

* cited by examiner

*Primary Examiner*—Gregory L. Huson
*Assistant Examiner*—Huyen Le
(74) *Attorney, Agent, or Firm*—Pearne & Gordon LLP

(57) ABSTRACT

A toilet (10) and toilet system suitable for a boat, recreational vehicle, bus or the like is operated via a microprocessor controller to effect a convenient and efficient operation. The toilet includes a base assembly (30) having an electrically-operated flush valve that opens and closes a passage to a waste receiving area. A flush lever assembly (15) has flush lever displaceable from a neutral position toward one of a "flush" position and an "add water" position. In this context, the flush lever initiates a flush cycle in the "flush" position and initiates an add water cycle in the "add water" position. The controller communicates with a water inlet valve, the flush valve and the flush lever assembly. In operation, the controller opens and closes the water inlet valve and controls a position of the flush valve in accordance with a position of the flush lever.

35 Claims, 10 Drawing Sheets

TOILET AND METHOD OF OPERATION

This application claims the benefit of Provisional Application No. 60/253,113 filed Nov. 28, 2000.

BACKGROUND OF THE INVENTION

The present invention relates to toilets and, more particularly, to a toilet and toilet system that is particularly suitable for a boat, recreational vehicle (RV), bus or the like.

The toilet according to the present invention may either be of the vacuum type (such as generally shown in U.S. Pat. No. 5,621,924, the disclosure of which is hereby incorporated by reference), or the drop through type.

There currently exist in the marine and RV industries, vacuum toilets and gravity drop toilets that are foot pedal or lever operated. These are manually operated toilets where a flush valve is opened by the operator and remains open as long as the operator activates the pedal or lever. In the vacuum toilet, if the flush valve is open for too short a period of time, insufficient water may accompany the waste, which may increase the possibility of the system plugging. A short duration flush also limits the amount of vacuum utilized in the flush and reduces the force that macerates the waste, which also increases the possibility of the system plugging. If the flush valve is open for an extended period of time, then excessive water is utilized. Additionally, if a second flush cycle is activated before the full level of vacuum is restored, the reduced level of vacuum may not have sufficient force to macerate the sewage, and system plugging may result.

In gravity drop toilets, if the flush valve is open for too short a period of time, then repeated opening of the flush valve may be required to clear the toilet bowl. If the flush valve is open for an extended period of time, then excessive water is utilized and it increases the possibility that malodor from the holding tank may enter the bathroom via the flush valve.

Since these toilets are manually operated, the timing between the flush valve and water valve is fixed and allows only one residual water lever. While "dry camping" or in rough seas, a lower level of residual water is desirable. When water is plentiful or in calm seas, a higher level of residual water may be desired.

SUMMARY OF THE INVENTION

The toilet and toilet system of the present invention generally includes a flush lever assembly for either activating a flush cycle or activating an add water cycle, a base assembly including components of an electrically-operated flush valve, and an electronic assembly incorporating a microprocessor controller that controls operation of the system. The components are housed within a one-piece bowl/base combination formed entirely of china. The dimensions and materials of the toilet mimic those of a conventional residential toilet.

In operation, a flush lever of the flush lever assembly is displaceable from a neutral position toward either a "flush" position or an "add water" position. Each respective position activates an operation cycle under the control of the microprocessor controller.

In the "add water" cycle, the controller opens a water inlet valve to add water to the bowl. Time limits may be set for the cycle based on a water level, which is selectable by the operator. In the "flush" cycle, the controller opens the water inlet valve and an electrically-operated flush valve to effect a flushing operation. The flush valve is generally held open for a set period of time and subsequently closed. The water valve is held open for a period of time that is dependent upon a refill level selected by the operator.

With the present invention, the operator initiates the flush cycle but does not control the duration. The flush cycle is controlled by the logic implemented by the microprocessor. The water valve is independently controlled from the flush valve. Water starts to flow into the bowl before the flush valve is opened, and the flush valve is opened for an optimum time period. As a consequence, the quality of the flush is improved.

A second flush before full vacuum is restored is prevented. Additionally, the microprocessor may monitor the vacuum level and prevents the second flush even if the flush lever is activated.

The operator may be provided with a choice of three residual water levels via a selection switch to match the current residual water requirements.

In an exemplary embodiment of the invention, a toilet suitable for a boat, recreational vehicle, bus or the like is provided with a base assembly including an electrically-operated flush valve that opens and closes a passage to a waste receiving area. A flush lever assembly includes a flush lever displaceable from a neutral position toward one of a "flush" position and an "add water" position, the flush lever initiating a flush cycle in the "flush" position and initiating an add water cycle in the "add water" position. A controller communicates with a water inlet valve, the flush valve and the flush lever assembly. The controller opens and closes the water inlet valve and controls a position of the flush valve in accordance with a position of the flush lever. In a preferred embodiment, the flush valve is a ball valve.

The flush valve is preferably displaceable between a sealed position and a full open position, wherein the controller controls the position of the flush valve through a programmed cycle from the sealed position to the full open position and back to the sealed position in accordance with the signal from the flush lever. In this context, the flush valve may include an open limit switch that detects when the flush valve is in the full open position and a closed limit switch that detects when the flush valve is in the sealed position. The flush valve may be mounted on a valve shaft with the flush valve further including a first cam lobe that engages the open limit switch when the flush valve is in the full open position and a second cam lobe that engages the closed limit switch when the flush valve is in the sealed position. Additionally, the flush valve may further include a valve motor controlled by the controller and having a motor output shaft, a follower lever coupled with the valve shaft, and a cam lever engaging the follower lever at one end and the motor output shaft at an opposite end.

Preferably, the programmed cycle carried out by the controller opens the flush valve for a predetermined period of time during the flush cycle. In this context, the programmed cycle carried out by the controller may stage the opening of the flush valve. That is, the controller may begin opening the flush valve for a first predetermined period of time such as 0.1 seconds, then stop opening the flush valve for a second predetermined period of time such as 0.2 seconds, then continue opening until the flush valve reaches the full open position.

The flush lever assembly preferably includes an add water/flush switch coupled with the flush lever. The flush lever closes flush contacts of the add water/flush switch in the "flush" position and closes the add water contacts of the add water/flush switch in the "add water" position. The flush lever assembly may additionally include a water level switch communicating with the controller that enables the operator to select a water level in the toilet. Preferably, the water level switch includes a low position, a normal position, and a high position. In this context, the controller opens the water inlet valve during the flush cycle for a time that is based on the position of the water level switch. In a similar context, the controller limits a time of the add water cycle based on a position of the water level switch. The flush lever assembly may also include a mode switch that enables operator selection between the normal mode and a service mode.

In another exemplary embodiment of the invention, a flush valve assembly is provided for the toilet. The flush valve assembly includes an electrically-operated flush valve for opening and closing a passage to a waste receiving area. A controller communicates with a water inlet valve and the flush valve and serves to open and close the water inlet valve while controlling the position of the flush valve in accordance with a position of a flush actuating mechanism.

In yet another exemplary embodiment of the invention, a method of operating a toilet suitable for a boat, recreational vehicle, bus or the like includes the steps of (a) detecting a position of a flush lever in a flush lever assembly, and (b) controlling a water inlet valve and an electrically-operated flush valve that opens and closes a passage to a waste receiving area in accordance with a position of the flush lever by initiating a flush cycle in a "flush" position and initiating an add water cycle in an "add water" position.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
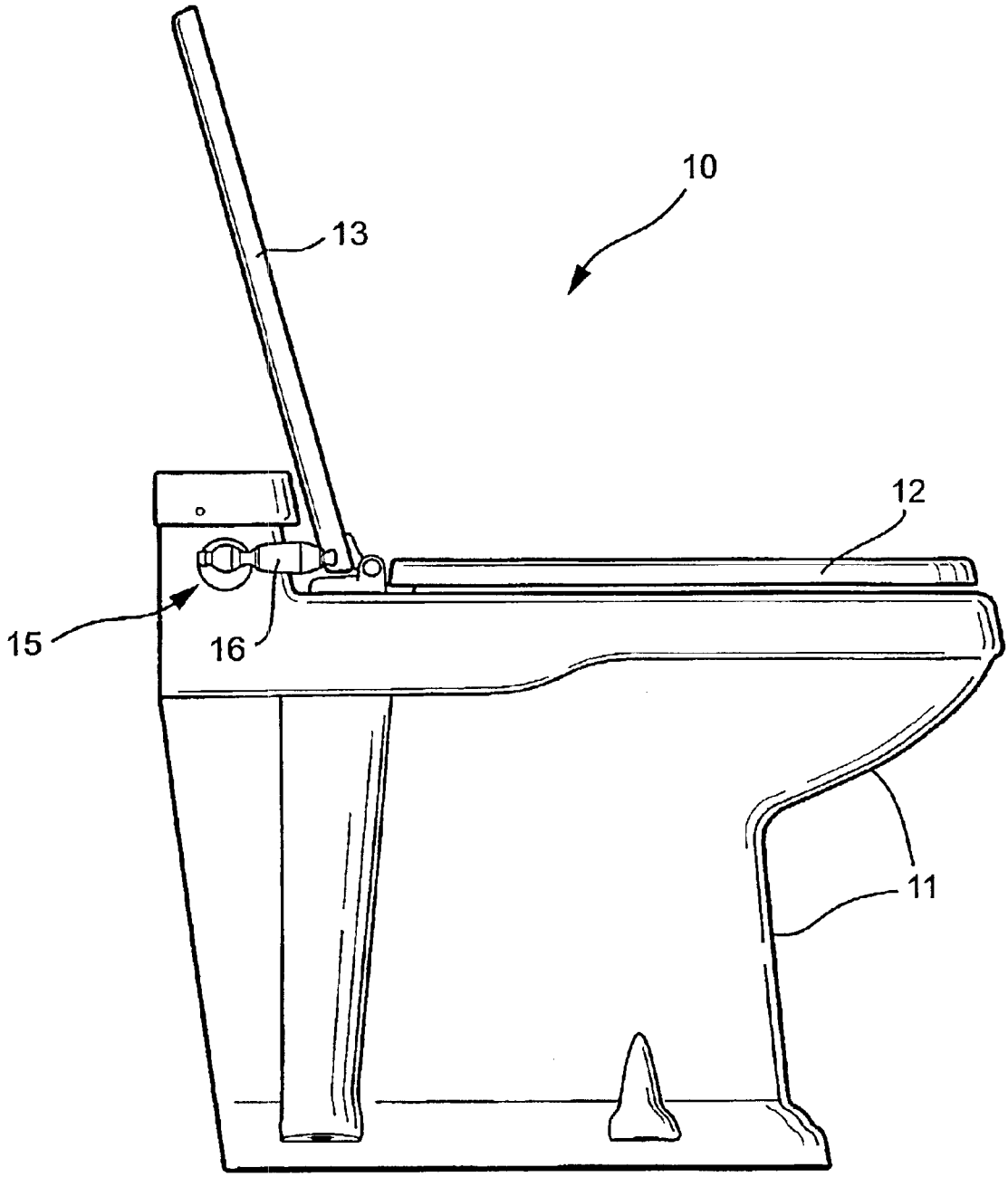
FIG. 1 is a side view of an exemplary toilet according to the invention.
Figure 2:
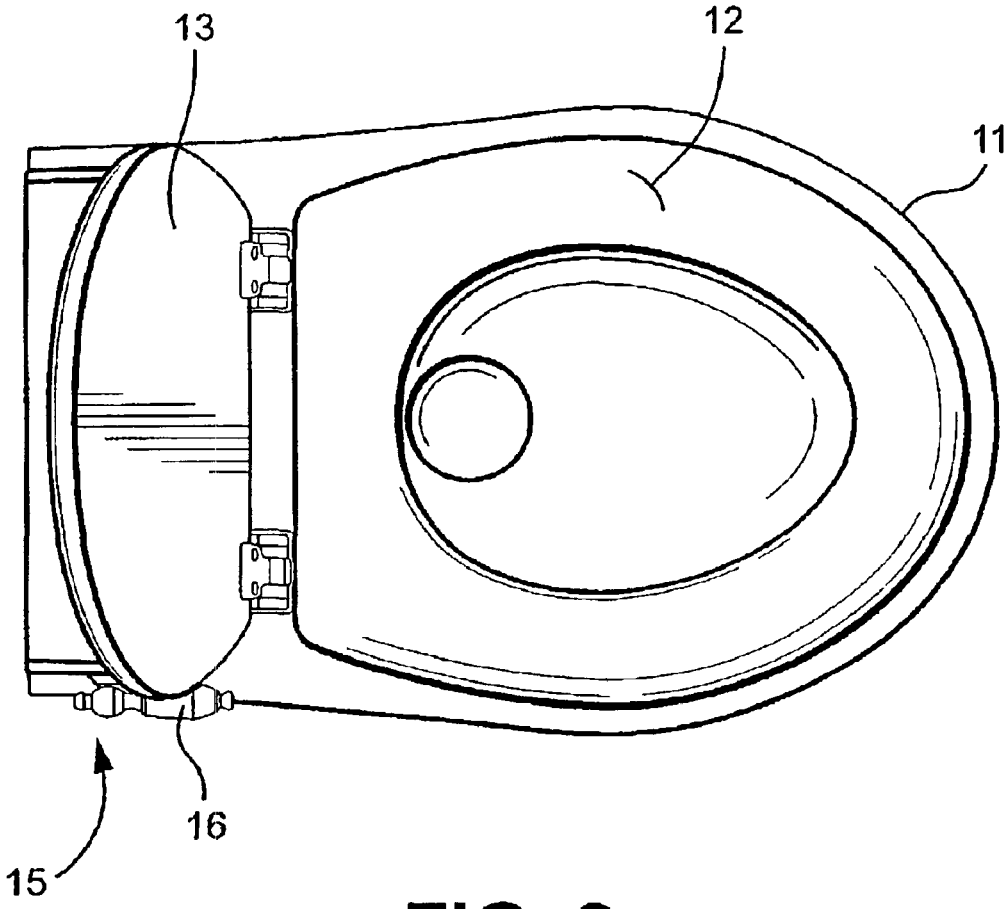
FIG. 2 is a top view of the toilet shown in FIG. 1.
Figure 3:
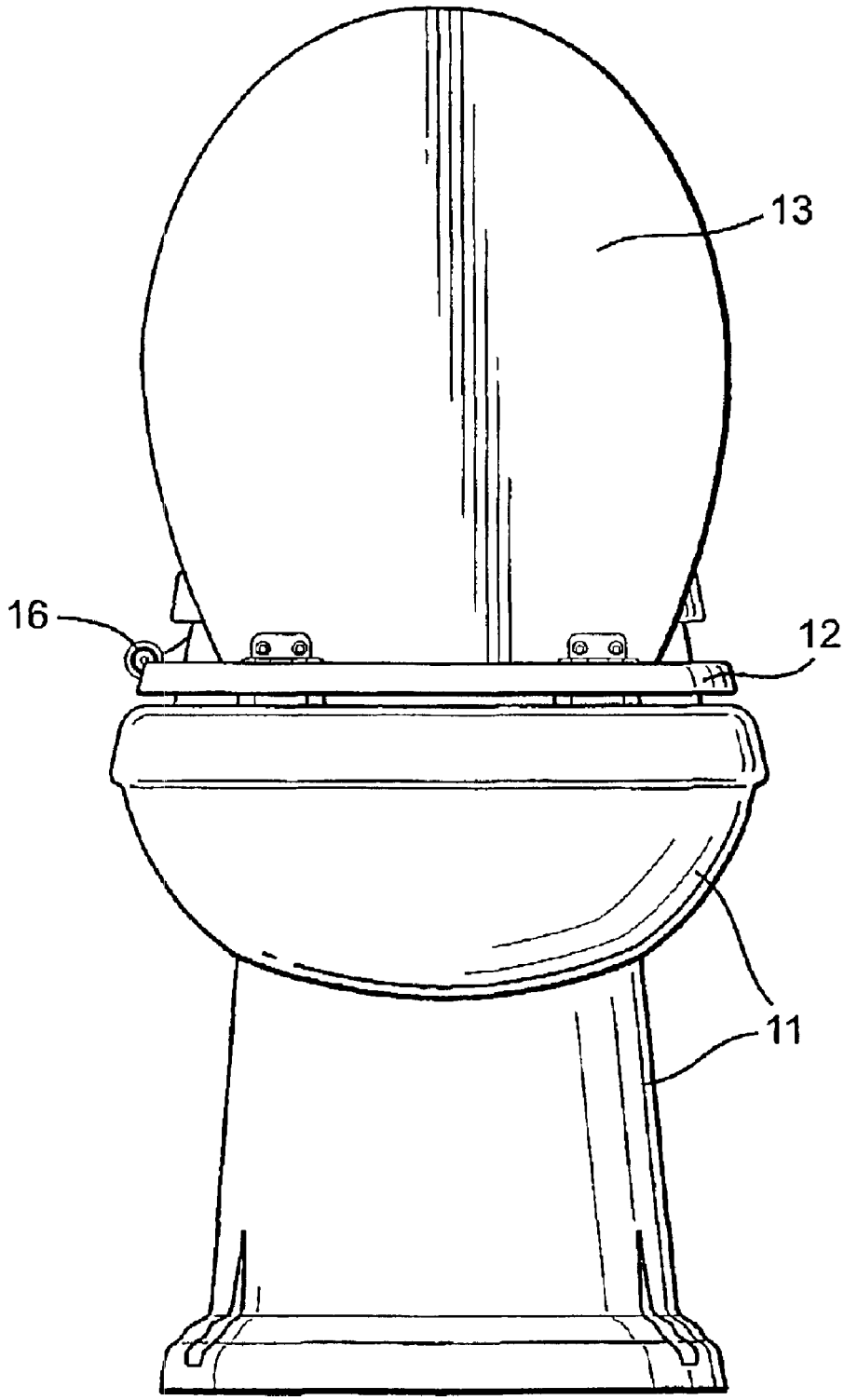
FIG. 3 is a front view of the toilet shown in FIG. 1.
Figure 4:
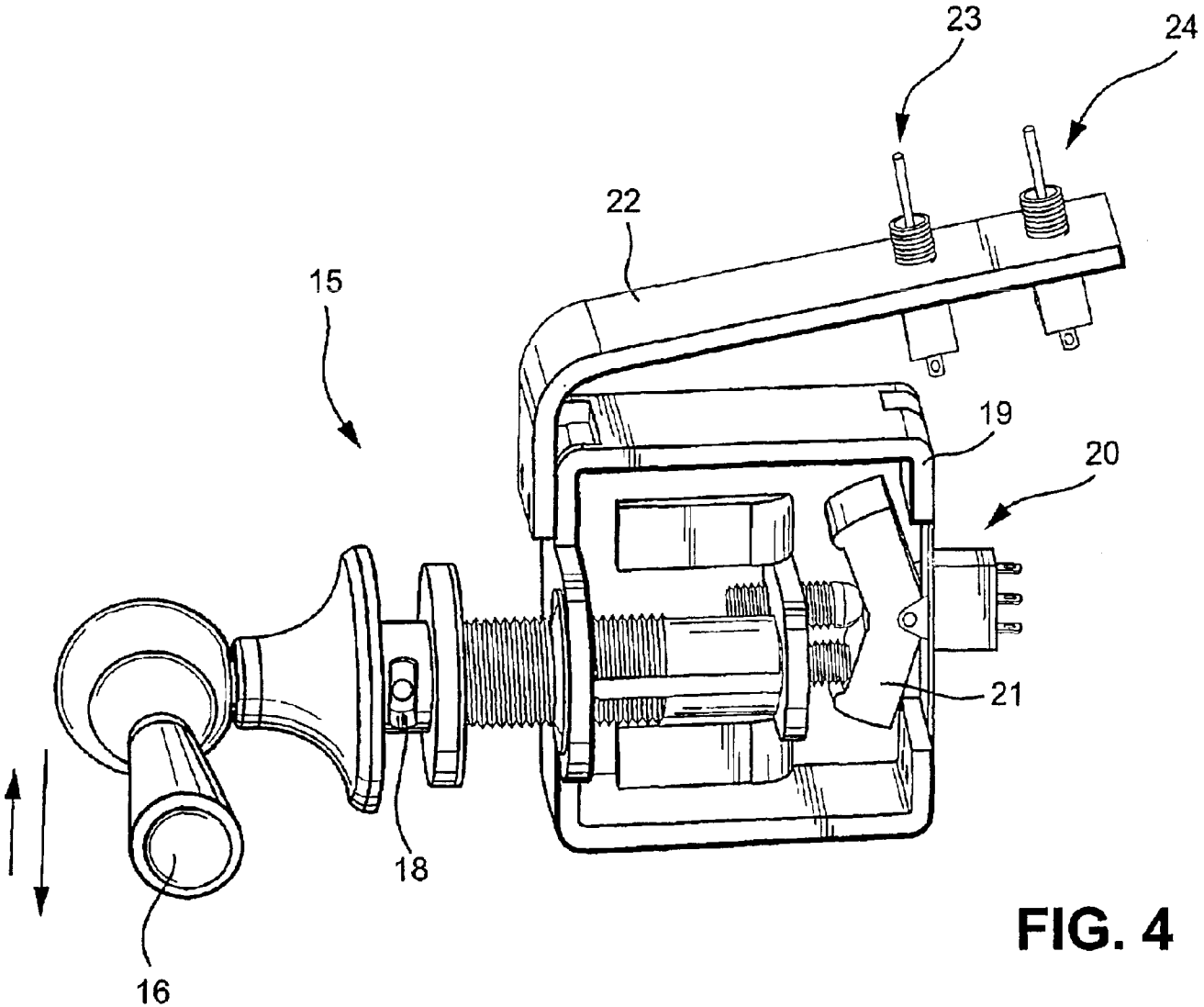
FIG. 4 is a detailed perspective view of a preferred embodiment of the flush lever assembly for the toilet of FIGS. 1–3.

FIGS. 1–3 show an exemplary toilet 10 (either vacuum or drop through) according to the invention having a substantially all china one-piece combination bowl and base 11, with a conventional toilet seat 12 and cover 13 associated therewith. In exterior appearance, the toilet 10 generally resembles conventional toilets found in homes, businesses and the like. The toilet 10 includes a flush lever assembly 15 associated therewith incorporating an actuating lever 16. An exemplary form of the flush lever assembly 15 is shown in more detail in FIG. 4.

The flush lever assembly 15 includes a shaft that may be rotated in either clockwise (flush) or counterclockwise (add water) directions about an axis (e.g., a substantially horizontal axis) by manipulating the actuating lever 16 to activate components mounted in the housing 19. In an exemplary embodiment, an electrical switch is mounted at one end of the housing 19 and is actuated to close "add water" contacts or "flush" contacts depending upon the direction in which the shaft 18 is rotated by the lever 16. Rotation of the shaft 18 causes an actuating lever 21 to be rocked from a neutral central position, against a centering spring bias, to either a "flush" contacts actuating position or an "add water" contacts actuating position. The closing of the "flush" contacts initiates a flush cycle as will be hereinafter described, while the closing of the "add water" contacts initiates an add water cycle as will also be hereinafter described to supply water to the bowl 11 when a flush valve such as a ball valve 33 (see FIGS. 5–7) of the toilet 10 is closed.

The housing 20 includes a switching strip 22 extending outwardly therefrom that mounts a low/normal/high residual water level electrical switch 23 and a service mode/normal mode electrical switch 24. The electrical interconnections between the switches 20, 23 and 24 and the rest of the components of the system are shown in FIG. 8.

Figure 5:
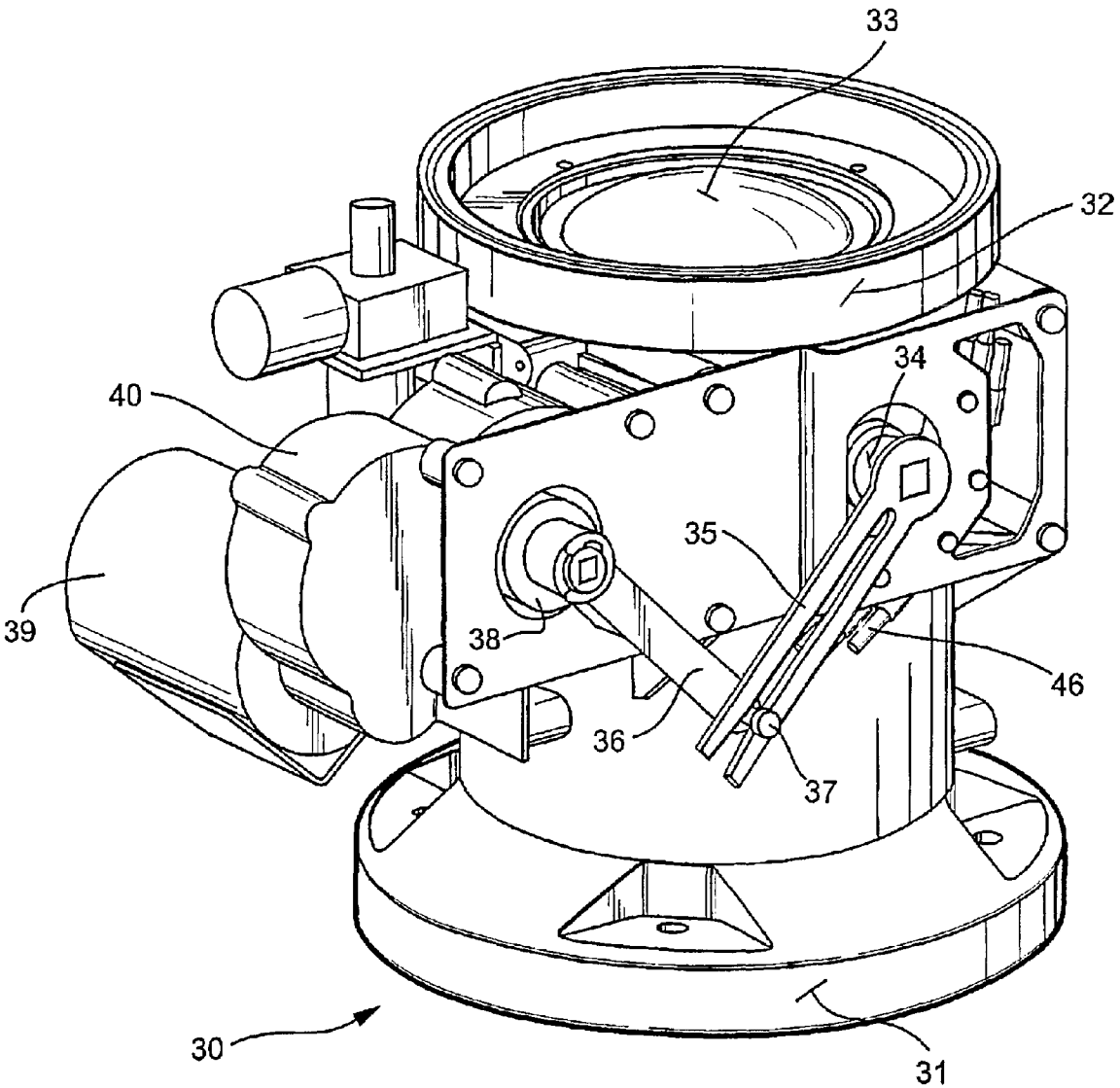
FIGS. 5–7 are perspective views of a preferred embodiment of a base assembly provided within a bowl and base combination of the toilet of FIGS. 1–3.
Figure 6:
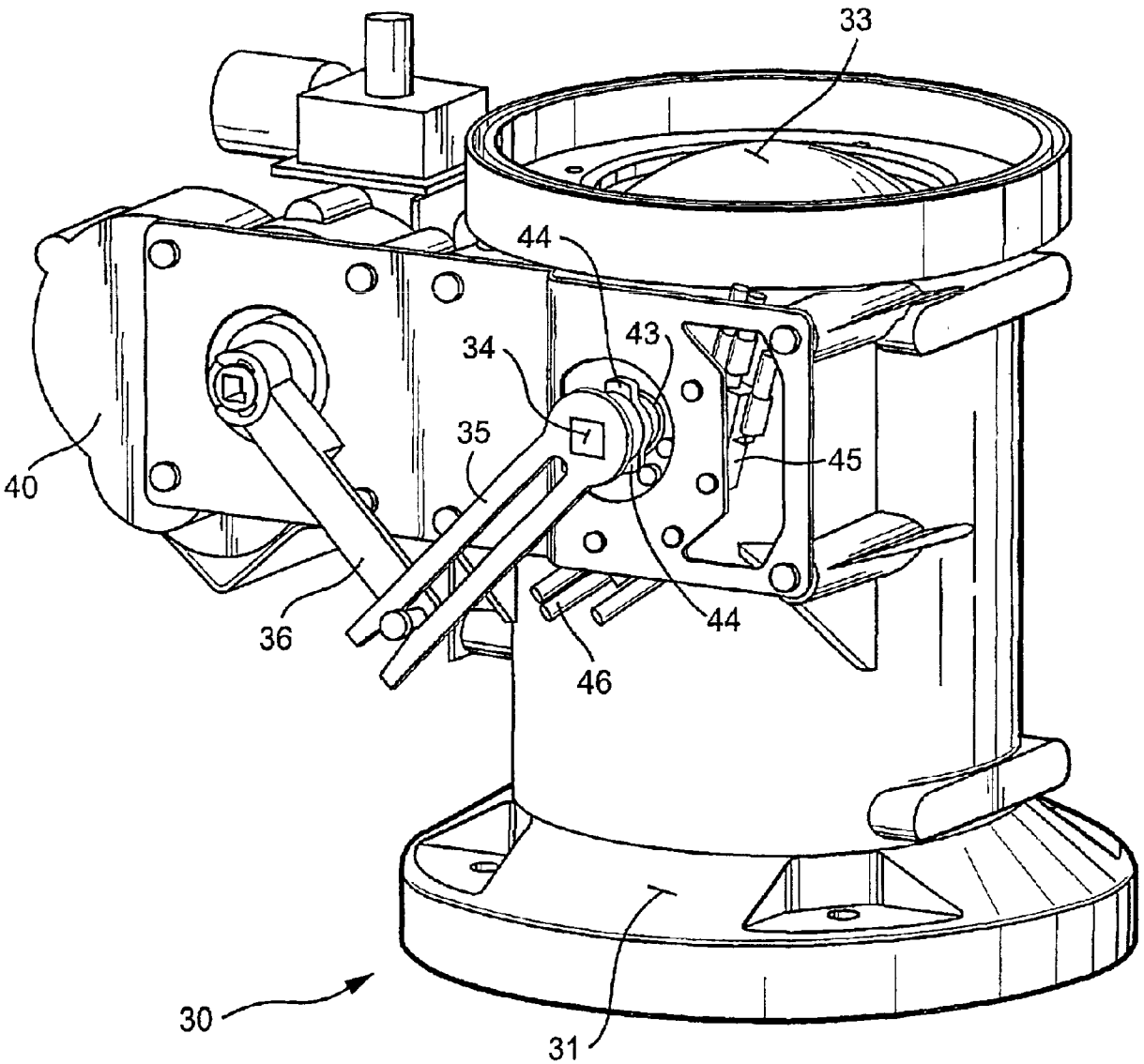
Figure 7:
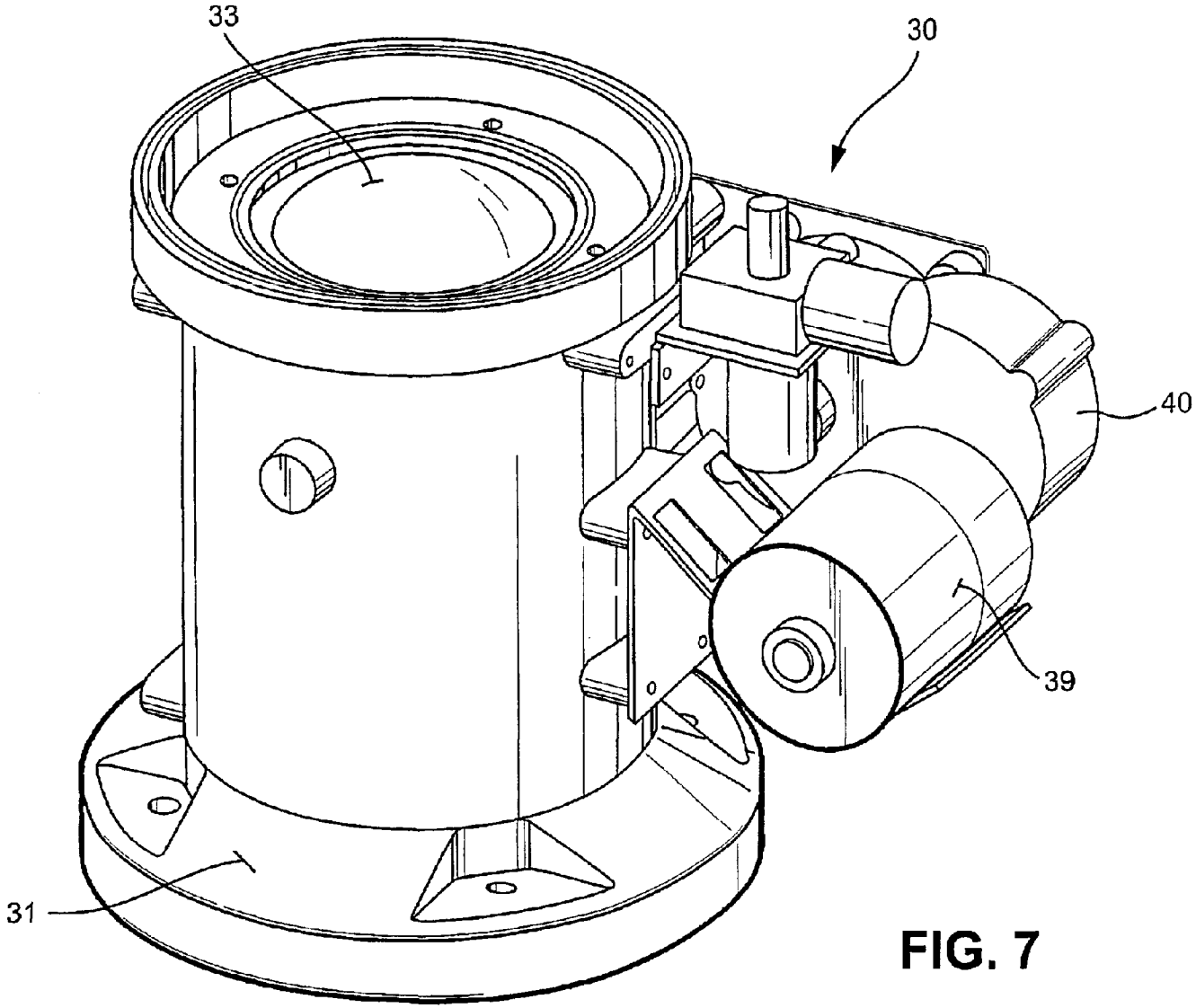

FIGS. 5–7 show an exemplary base assembly 30 that may be utilized within the one-piece bowl/base combination 11 of FIGS. 1–3, below the interior bottom of the bowl portion thereof. A ring 31 provides bottom support for the assembly 30, and an upper ring 32 provides a support for a flush valve 33 such as ball valve. The flush valve 33 is coupled to a valve shaft 34 that is driven by a motor 39 through a gearing assembly 40 via first and second levers or links 35, 36 interconnected by a pin 37. The pin 37 is attached to the second lever 36 and slides in a track within the first lever 35 as shown in FIGS. 5 and 6. The flush valve 33 is rotated between a sealed position in which a passageway to a waste area is sealed and a full open position that opens a passage to the waste receiving area. Pivotal movement of the lever 36 to rotate the shaft 34 (and thereby rotate the flush valve 33) is effected by rotation of the shaft 38, which in turn is rotated by the motor 39, such as a DC electric motor, through the gearing assembly 40.

With particular reference to FIG. 6, the valve shaft 34 is preferably provided with a cam 43 mounted thereon, with cam lobes 44 extending radially outwardly therefrom. The lobes 44, upon rotation of the valve shaft 34, actuate a closed 45 or open 46 limit switch based on a position of the valve shaft 34. That is, one cam lobe 44 engages the open limit switch 46 when the flush valve 33 is in the full open position, and the other cam lobe 44 engages the closed limit switch 45 when the flush valve 33 is in the sealed position.

Figure 8A:
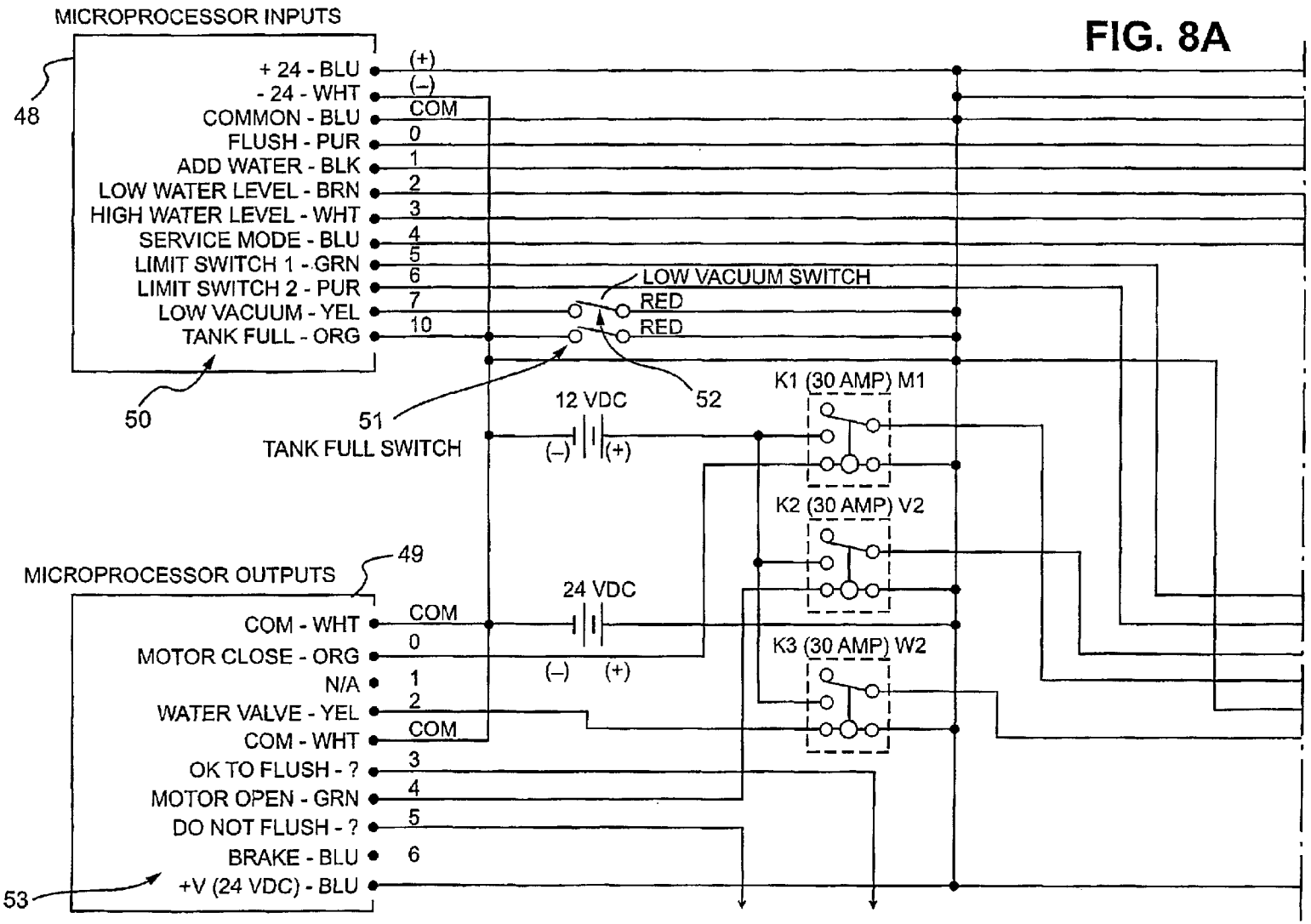
FIGS. 8A and 8B show an electrical schematic showing the interconnections between a microprocessor and various other components of a preferred electrical system used in the toilet and with the toilet system of FIGS. 1–7.
Figure 8B:
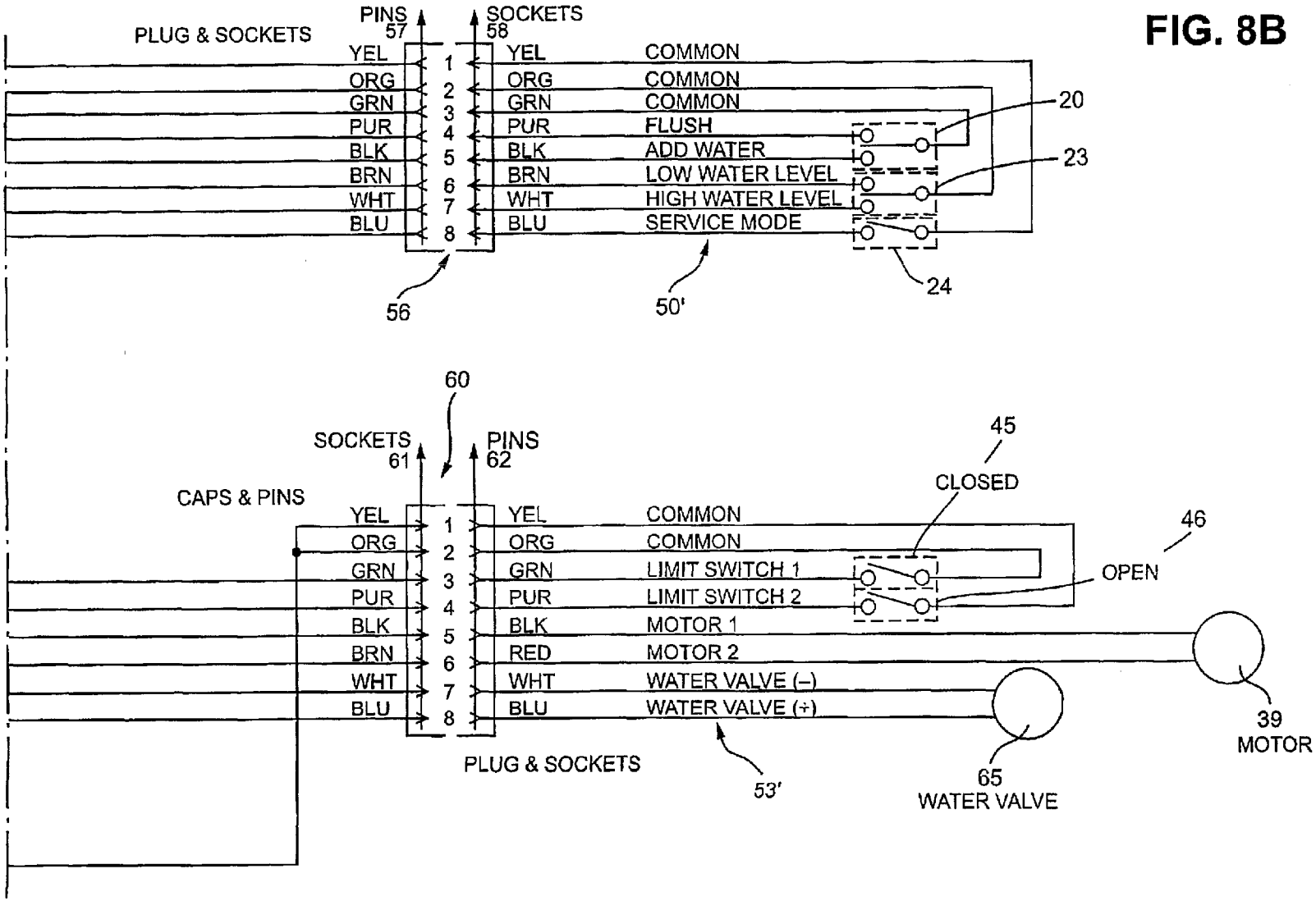

FIGS. 8 (8A, 8B) is an electrical schematic that shows the interconnections between the microprocessor inputs 48 and outputs 49 (which are preferably part of a single microprocessor), and other desired electrical components of the system, which are controlled by the microprocessor having the inputs 48 and outputs 49. The electrical components include a "tank full" switch 51 associated with a conventional holding tank for the toilet system, and a "low vacuum" switch 52 associated with the conventional vacuum tank of the toilet system (when the toilet 10 is a vacuum toilet). The names/functions of the inputs 48 are shown in column 50 in FIG. 8, while the names/functions of the outputs 49 are shown in column 53. In this context, the circuit diagram shown in FIG. 8 is merely exemplary, and those of ordinary skill in the art may certainly contemplate alternative means for carrying out the microprocessor connections and functions according to the present invention.

Thus, aside from the detail discussed above, no further description of the circuit diagram will be provided.

FIG. 8 additionally shows, generally at 56, plugs and sockets associated with the microprocessor input 48, including pins 57 and sockets 58, labeled as seen in FIG. 8 and associated with the names/functions in column 50' corresponding to the names/functions in column 50. The plugs and sockets shown generally at 60 are associated with the microprocessor outputs 49, including sockets 61 and pins 62 at the bottom of FIG. 8 and the names/functions in column 53' correspond to the names/functions in column 53. FIG. 8 also shows switches from the flush lever assembly 15 including electrical switch 20, water level switch 23, and mode switch 24. Additionally, limit switches 45 and 46 are also shown.

The microprocessor also communicates with a water inlet valve 65 that flows fresh water into the bowl during operation of the toilet system.

Figure 9A:
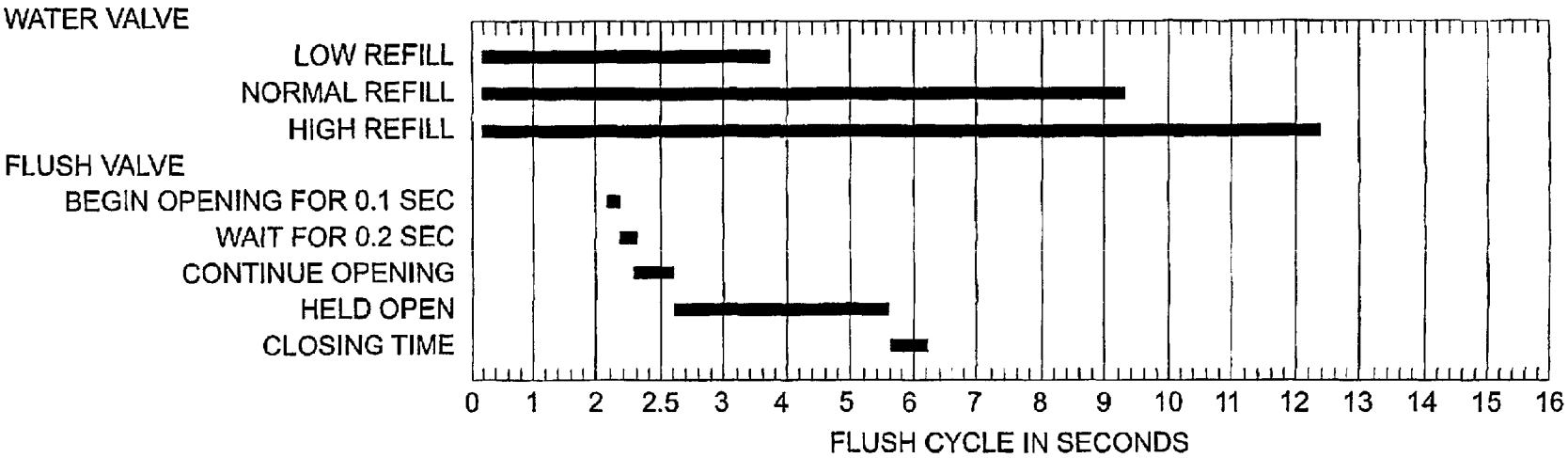
FIGS. 9A and 9B are exemplary timing charts showing the operation of the toilet according to the present invention.
Figure 9B:
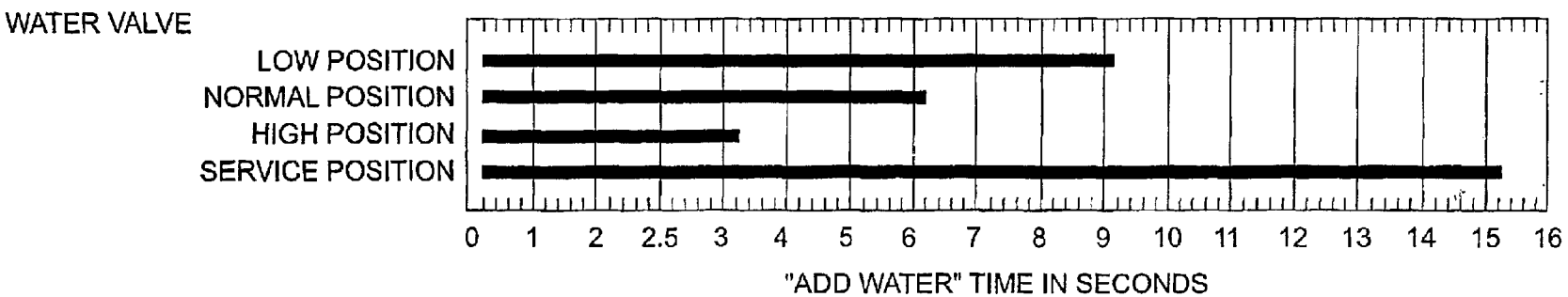

FIGS. 9A and 9B show timing charts for operating modes of the toilet system according to the present invention. With reference to FIG. 9A, a flush cycle is initiated when the flush lever 16 is rotated to close the "flush" contacts of the electrical switch 20. During the flush cycle, the controller first opens the water inlet valve 65 to allow fresh water to flow into the bowl. As seen in FIG. 9A, the amount of time that the controller keeps open the water inlet valve depends upon a position of the water level switch 23. After opening the water valve for a short period of time, such as 2.1 seconds as shown in FIG. 9A, the controller begins opening the flush valve 33 via the motor 39. The motor 39 is activated to open the flush valve 33 until one of the cam lobes 44 engages the open limit switch 46, signifying that the flush valve 33 has reached its full open position. The controller maintains the flush valve 33 in its full open position for a predetermined period of time (about 3 seconds in FIG. 9A after reaching the full open position). Subsequently, the motor 39 is driven in a reverse direction to close the flush valve 33 to its sealed position.

In a preferred embodiment, the controller effects opening of the flush valve 33 in stages to prevent any splash back of residual water out of the bowl. That is, with continued reference to FIG. 9A, the controller effects opening the flush valve 33 for a first predetermined period of time (e.g., 0.1 seconds shown in FIG. 9A), then stops opening the flush valve for a second predetermined period of time (e.g., 0.2 seconds shown in FIG. 9A), then continues opening until the flush valve 33 reaches its full open position. In this manner, any residual water splash back will contact the flush valve 33 and will not reach the exterior of the bowl. By partially opening the flush valve for a short duration, the vacuum level is reduced during the full opening by controlling the vacuum inlet via the flush valve. Additionally, any splash back will contact the underside of the flush valve and reduce or eliminate an amount that reaches the exterior of the bowl.

FIG. 9B is a timing chart showing "add water" time limits for the add water cycle of the toilet system. The "add water" cycle is initiated when the flush lever 16 is rotated to close "add water" contacts of the electrical switch 20. When the add water cycle is initiated, the controller effects opening of the water inlet valve 65 to flow water into the bowl. As seen in FIG. 9B, time limits for the add water cycle vary based on a position of the water level switch 23. In this manner, for example, if the water level switch 23 is set to a low position, thereby keeping the amount of water in the bowl at a low level, the bowl has additional capacity for the add water cycle, and the add water cycle time limit is higher (e.g., about 9 seconds in FIG. 9B). On the other hand, if the water level switch is set in a high position, the bowl has considerably less capacity for the add water cycle, and the add water time limit is significantly shorter (e.g., about 3 seconds in FIG. 9B). In a similar context, when the mode switch 24 is set to the service mode, the flush valve 33 is generally held open, and the add water time limit can be considerably longer (e.g., about 15 seconds in FIG. 9B).

With the system according to the present invention, an efficient operating toilet suitable for a boat, recreational vehicle, bus or the like is provided. A microprocessor controller controls the operation of the system to effect convenient and efficient operation.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A toilet suitable for a boat, recreational vehicle, bus or the like, the toilet comprising:

a base assembly including an electrically-operated flush valve that opens and closes a passage to a waste receiving area;

a flush lever assembly including a flush lever displaceable from a neutral position toward one of a "flush" position and an "add water" position, the flush lever initiating a flush cycle in the "flush" position and initiating an add water cycle in the "add water" position; and a controller communicating with a water inlet valve, the flush valve and the flush lever assembly, the controller opening and closing the water inlet valve and controlling a position of the flush valve in accordance with a position of the flush lever.

2. A toilet according to claim 1, wherein the flush valve comprises a ball valve.

3. A toilet according to claim 1, wherein the flush valve is displaceable between a sealed position and a full open position, and wherein the controller controls the position of the flush valve through a programmed cycle from the sealed position to the full open position and back to the sealed position in accordance with a signal from the flush lever.

4. A toilet according to claim 3, wherein the flush valve comprises an open limit switch that detects when the flush valve is in the full open position and a closed limit switch that detects when the flush valve is in the sealed position.

5. A toilet according to claim 4, wherein the flush valve is mounted on a valve shaft, and wherein the flush valve further comprises a first cam lobe that engages the open limit switch when the flush valve is in the full open position and a second cam lobe that engages the closed limit switch when the flush valve is in the sealed position.

6. A toilet according to claim 5, wherein the flush valve further comprises:

a valve motor controlled by the controller and having a motor output shaft;

a follower lever coupled with the valve shaft; and a cam lever engaging the follower lever at one end and the motor output shaft at an opposite end.

7. A toilet according to claim 3, wherein the programmed cycle carried out by the controller opens the flush valve for a predetermined period of time during the flush cycle.

8. A toilet according to claim 7, wherein the programmed cycle carried out by the controller stages opening of the flush valve.

9. A toilet according to claim 7, wherein the programmed cycle carried out by the controller begins opening the flush valve for a first predetermined period of time, then stops opening the flush valve for a second predetermined period of time, then continues opening until the flush valve reaches the full open position.

10. A toilet according to claim 9, wherein the first predetermined period of time is 0.1 seconds and the second predetermined period of time is 0.2 seconds.

11. A toilet according to claim 1, wherein the flush lever assembly comprises an add water/flush switch coupled with the flush lever, the flush lever closing flush contacts of the add water/flush switch in the "flush" position and closing add water contacts of the add water/flush switch in the "add water" position.

12. A toilet according to claim 1, wherein the flush lever assembly comprises a water level switch communicating with the controller, the water level switch enabling operator selection of a water level in the toilet.

13. A toilet according to claim 12, wherein the water level switch comprises a low position, a normal position, and a high position.

14. A toilet according to claim 13, wherein the controller opens the water inlet valve during the flush cycle for a time that is based on the position of the water level switch.

15. A toilet according to claim 13, wherein the controller limits a time of the add water cycle based on a position of the water level switch.

16. A toilet according to claim 1, wherein the flush lever assembly comprises a mode switch communicating with the controller, the mode switch enabling operator selection between a normal mode and a service mode.

17. A toilet according to claim 1, further comprising a bowl/base combination housing the base assembly, the flush lever assembly and the controller, the bowl/base combination being of one-piece and formed entirely of china.

18. A flush valve assembly for a toilet, the flush valve assembly comprising:

an electrically-operated flush valve for opening and closing a passage to a waste receiving area;

a controller communicating with a water inlet valve and the flush valve, the controller opening and closing the water inlet valve and controlling a position of the flush valve in accordance with a position of a flush actuating mechanism;

wherein the flush valve is displaceable between a sealed position and a full open position, and wherein the controller controls the position of the flush valve through a programmed cycle from the sealed position to the full open position and back to the sealed position in accordance with a signal from the flush actuating mechanism;

wherein the flush valve comprises an open limit switch that detects when the flush valve is in the full open position and a closed limit switch that detects when the flush valve is in the sealed position; and wherein the flush valve is mounted on a valve shaft, and wherein the flush valve further comprises a first cam lobe that engages the open limit switch when the flush valve is in the full open position and a second cam lobe that engages the closed limit switch when the flush valve is in the sealed position.

19. A flush valve assembly according to claim 18, wherein the flush valve further comprises:

a valve motor controlled by the controller and having a motor output shaft;

a follower lever coupled with the valve shaft; and a cam lever engaging the follower lever at one end and the motor output shaft at an opposite end.

20. A flush valve assembly for a toilet, the flush valve assembly comprising:

an electrically-operated flush valve for opening and closing a passage to a waste receiving area;

a controller communicating with a water inlet valve and the flush valve, the controller opening and closing the water inlet valve and controlling a position of the flush valve in accordance with a position of a flush actuating mechanism;

wherein the flush valve is displaceable between a sealed position and a full open position, and wherein the controller controls the position of the flush valve through a programmed cycle from the sealed position to the full open position and back to the sealed position in accordance with a signal from the flush actuating mechanism;

wherein the programmed cycle carried out by the controller opens the flush valve for a predetermined period of time during a flush cycle; and wherein the programmed cycle carried out by the controller begins opening the flush valve for a first predetermined period of time, then stops opening the flush valve for a second predetermined period of time, then continues opening until the flush valve reaches the full open position.

21. A flush valve assembly according to claim 20, wherein the first predetermined period of time is 0.1 seconds and the second predetermined period of time is 0.2 seconds.

22. A method of operating a toilet suitable for a boat, recreational vehicle, bus or the like, the method comprising:

(a) detecting a position of a flush lever in a flush lever assembly; and (b) controlling a water inlet valve and an electrically-operated flush valve that opens and closes a passage to a waste receiving area in accordance with a position of the flush lever by initiating a flush cycle in a "flush" position and initiating an add water cycle in an "add water" position.

23. A method according to claim 22, wherein the flush valve is displaceable between a sealed position and a full open position, and wherein step (b) is practiced by controlling a position of the flush valve through a programmed cycle from the sealed position to the full open position and back to the sealed position in accordance with a signal from the flush lever.

24. A method according to claim 23, wherein step (b) is further practiced by detecting when the flush valve is in the full open position and detecting when the flush valve is in the sealed position.

25. A method according to claim 23, wherein the programmed cycle is carried out by opening the flush valve for a predetermined period of time during the flush cycle.

26. A method according to claim 25, wherein the programmed cycle is carried out by opening the flush valve in stages.

27. A method according to claim 25, wherein the programmed cycle is carried out by opening the flush valve for a first predetermined period of time, stopping opening of the flush valve for a second predetermined period of time, then continuing opening until the flush valve reaches the full open position.

28. A method according to claim 27, wherein the first predetermined period of time is 0.1 seconds and the second predetermined period of time is 0.2 seconds.

29. A method according to claim 22, wherein step (b) is practiced by opening the water inlet valve during the flush cycle for a time that is based on a position of a user-operated water level switch.

30. A method according to claim 22, wherein step (b) is practiced by limiting a time of the add water cycle based on a position of a user-operated water level switch.

31. A method according to claim 22, further comprising enabling operator selection between a normal mode and a service mode.

32. A toilet comprising:

a bowl;

a flush valve that opens and closes a passage from the bowl to a waste receiving area;

a water level switch having a first state and a second state;

a water inlet valve connected to admit water into the bowl;

flush controller connected to operate the flush valve and the water inlet valve, wherein at least one of the water inlet valve and the flush valve are controlled to a fill the bowl to a first water level when the water level switch is in the first state and at least one of the water inlet valve and the flush valve are controlled to fill the bowl to a second water level when the water level switch is in the second state.

33. A toilet according to claim 32, wherein the flush controller is connected to open the water inlet valve for a time dependent on the state of the water level switch.

34. A toilet according to claim 32, wherein the flush controller is connected to open the water inlet valve for a longer time when the water level switch is in the first state and a shorter time when the water level switch is in the second state.

35. A method of operating a toilet comprising the steps of:

detecting a state of a water level switch having at least two states;

operating at least one of the flush valve and the water inlet valve to fill the bowl to a first water level when the water level switch is in a first one of the states; and operating at least one of the flush valve and the water inlet valve to fill the bowl to a second water level when the water level switch is in a second one of the states.

* * * * *